US009989229B2

(12) United States Patent
Pieper

(10) Patent No.: US 9,989,229 B2
(45) Date of Patent: Jun. 5, 2018

(54) SYSTEM, APPARATUS AND METHOD FOR A DIMMABLE CIRCUIT

(71) Applicant: Ryan R. Pieper, Alexandria, VA (US)

(72) Inventor: Ryan R. Pieper, Alexandria, VA (US)

( * ) Notice: Subject to any disclaimer, the term of this patent is extended or adjusted under 35 U.S.C. 154(b) by 0 days. days.

(21) Appl. No.: 15/371,432

(22) Filed: Dec. 7, 2016

(65) Prior Publication Data

US 2017/0164450 A1 Jun. 8, 2017

Related U.S. Application Data

(60) Provisional application No. 62/264,031, filed on Dec. 7, 2015.

(51) Int. Cl.

| | |
|---|---|
| ***F21V 23/00*** | (2015.01) |
| ***F21V 21/28*** | (2006.01) |
| ***F21V 23/04*** | (2006.01) |
| ***H01H 1/00*** | (2006.01) |

(52) U.S. Cl.

CPC ..... *F21V 23/003* (2013.01); *F21V 21/28* (2013.01); *F21V 23/04* (2013.01); *H01H 1/00* (2013.01)

(58) Field of Classification Search

CPC ..... G07C 5/008; G07C 5/085; G07C 5/0808; B60R 21/213; B60R 21/233; B60R 21/235; B60R 2021/0004; B60R 2021/01088; B60R 2021/23107; B60R 2021/23153; B60R 2021/23161; B60R 2021/23169; B60R 2021/23

See application file for complete search history.

(56) References Cited

U.S. PATENT DOCUMENTS

| | | | |
|---|---|---|---|
| 3,678,485 | A | 7/1972 | Jones |
| 4,338,547 | A | 7/1982 | McCaslin |
| 5,041,947 | A | 8/1991 | Yuen et al. |
| 5,596,247 | A | 1/1997 | Martich et al. |
| 5,951,155 | A | 9/1999 | Lanser |
| 6,238,054 | B1 | 5/2001 | Doell |
| 7,165,857 | B2 | 1/2007 | Fong |
| 7,217,023 | B2 | 5/2007 | Iwasa et al. |
| 7,654,693 | B2 | 2/2010 | Rasmussen et al. |
| 7,909,490 | B2 | 3/2011 | Chou et al. |
| 8,803,447 | B2 | 8/2014 | Nakamura |
| 9,072,133 | B2 | 6/2015 | Chemel et al. |

(Continued)

FOREIGN PATENT DOCUMENTS

| | | |
|---|---|---|
| CN | 103868636 A | 6/2014 |

*Primary Examiner* — Monica C King

(57) ABSTRACT

According to an exemplary embodiment, a dimmable circuit for operating a lighting fixture may be provided. The dimmable circuit may be capable of regulating the output intensity of a connected light source via the rotational angular displacement of an arm fixture. The dimmable circuit may include a housing, an arm fixture with at least one light source mounted thereto, a rotatable shaft that provides angular rotational movement of the arm fixture about the housing, an encoder, an electrical control unit, and a slip ring. The rotatable shaft may support multiple complete rotations of the arm fixture, as well as rotations below and beyond 360 degrees. Further, a programmable microprocessor may be used to manipulate various light characteristics of the light source according to predetermined dimming patterns.

18 Claims, 9 Drawing Sheets

(56) References Cited

U.S. PATENT DOCUMENTS

| | | | | |
|---|---|---|---|---|
| 2007/0281581 | A1* | 12/2007 | Rago | A63H 1/24<br>446/242 |
| 2011/0015569 | A1* | 1/2011 | Kirschenman | A61B 17/2909<br>604/95.01 |
| 2014/0358281 | A1* | 12/2014 | Lipton | G09F 11/02<br>700/245 |
| 2015/0035437 | A1 | 2/2015 | Panopoulos | |

* cited by examiner

SYSTEM, APPARATUS AND METHOD FOR A DIMMABLE CIRCUIT

CROSS-REFERENCE TO RELATED APPLICATIONS

This application claims priority from U.S. Provisional Patent Application No. 62/264,031, filed on Dec. 7, 2015, entitled "System, Apparatus, and Method for a Dimmable Circuit," the entire contents of which are hereby incorporated by reference in their entirety.

BACKGROUND

Light dimmers are variable-voltage switches typically intended to control light output from resistive incandescent, halogen, LED, or fluorescent lights. The act of dimming may be accomplished by using a rotary potentiometer integrated with the light source circuitry.

A rotary potentiometer may include a resistive material, a stationary arm, and a moving contact arm that slides across the resistive material. An operator can control the amount of voltage supplied to a light source by adjusting a knob that is connected directly to the potentiometer. Rotation of the knob determines the position of the internal moving contact arm on the resistive material. If the moving arm is positioned closer to the stationary arm, electrical current will travel through less resistive material, thus allowing more input voltage to the bulb. As the contact arm is positioned farther away from the stationary arm, the more resistive material the electrical current encounters, producing a dimmer glow.

Some light dimmers may include a rotary potentiometer that may remain set at its last position, and the switch may be operated by a push action whereas other types of light dimmers may be turned on and off by axial presses of the knob. The vast majority of potentiometers used in these dimmer circuits have a sweep of 270 degrees and may incorporate an on/off 'click' threshold that tells the operator whether power is being supplied to the bulb. However, modern dimmers are often controlled by a digital control system that can be used in conjunction with a wireless network. However, such dimmers often lack some desired functionality in their adjustability and utilize structures and housings that fail to offer desired tactile appeal and aesthetics. Additionally, such dimmers and associated light fixtures do not provide any method of controlling location or direction of light provided.

It is well known that there is an ever-present need for decorative lighting systems for residential and commercial lighting applications. Such lighting systems are particularly appealing if they function in both an ornamental and utilitarian fashion. There is thus a need for a contemporary lighting system that provides versatility in operation as well as aesthetic appeal. It is a principle object of the invention to provide an interactive lighting system that is easily customizable, offers ease of operation and assembly, and maintains low production costs.

SUMMARY

According to an exemplary embodiment, a method, system, and apparatus for a dimmable circuit, for example used to operate a rotatable lighting fixture, may be provided. The dimmable circuit may be capable of regulating the output intensity of a connected light source via the rotational angular displacement of an arm fixture. The dimmable circuit may include a housing, an arm fixture with at least one light source mounted thereto, a rotatable shaft coupled to the arm fixture that provides angular rotational movement of the arm fixture about the housing, an encoder connected to the rotatable shaft to generate and transmit data on the angular rotational movement of the rotatable shaft, an electrical control unit that receives and processes data from the encoder, and further regulates at least one light characteristic of the at least one light source based on the data received, and a slip ring attached to the rotatable shaft that transmits electrical power from electrical control unit to the at least one light source. The rotatable shaft may support multiple complete rotations of the arm fixture, as well as rotations below and beyond 360 degrees. The encoder may be arranged to rotate in response to rotation of the shaft, and may convert the angular position or motion of the shaft into electronic pulses that are transmitted to the electrical control unit. It may further be appreciated that the encoder is capable of providing a measurement of either the absolute angle of rotation or incremental changes in the angle of rotation of the shaft. Further, a programmable microprocessor may be used to manipulate various light characteristics (e.g., luminosity, color, temperature) of the light source according to predetermined dimming patterns.

BRIEF DESCRIPTION OF THE DRAWINGS

Advantages of embodiments of the present invention will be apparent from the following detailed description of the exemplary embodiments. The following detailed description should be considered in conjunction with the accompanying figures in which.

DETAILED DESCRIPTION

Aspects of the present invention are disclosed in the following description and related figures directed to specific embodiments of the invention. Those skilled in the art will recognize that alternate embodiments may be devised without departing from the spirit or the scope of the claims. Additionally, well-known elements of exemplary embodiments of the invention will not be described in detail or will be omitted so as not to obscure the relevant details of the invention.

As used herein, the word "exemplary" means "serving as an example, instance or illustration." The embodiments described herein are not limiting, but rather are exemplary only. It should be understood that the described embodiments are not necessarily to be construed as preferred or advantageous over other embodiments. Moreover, the terms "embodiments of the invention", "embodiments" or "invention" do not require that all embodiments of the invention include the discussed feature, advantage, or mode of operation.

Figure 1:
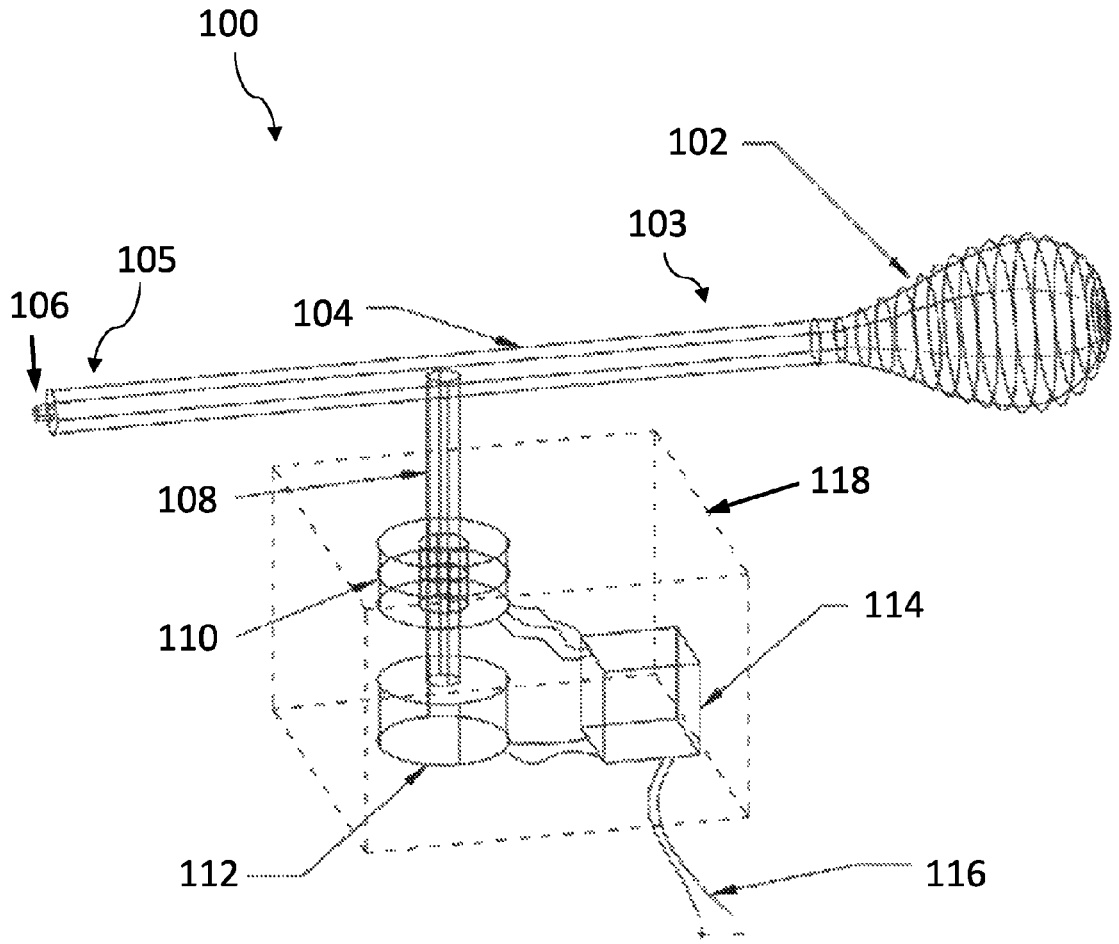
FIG. 1 is a perspective view of an exemplary embodiment of a dimmable circuit.
Figure 2:
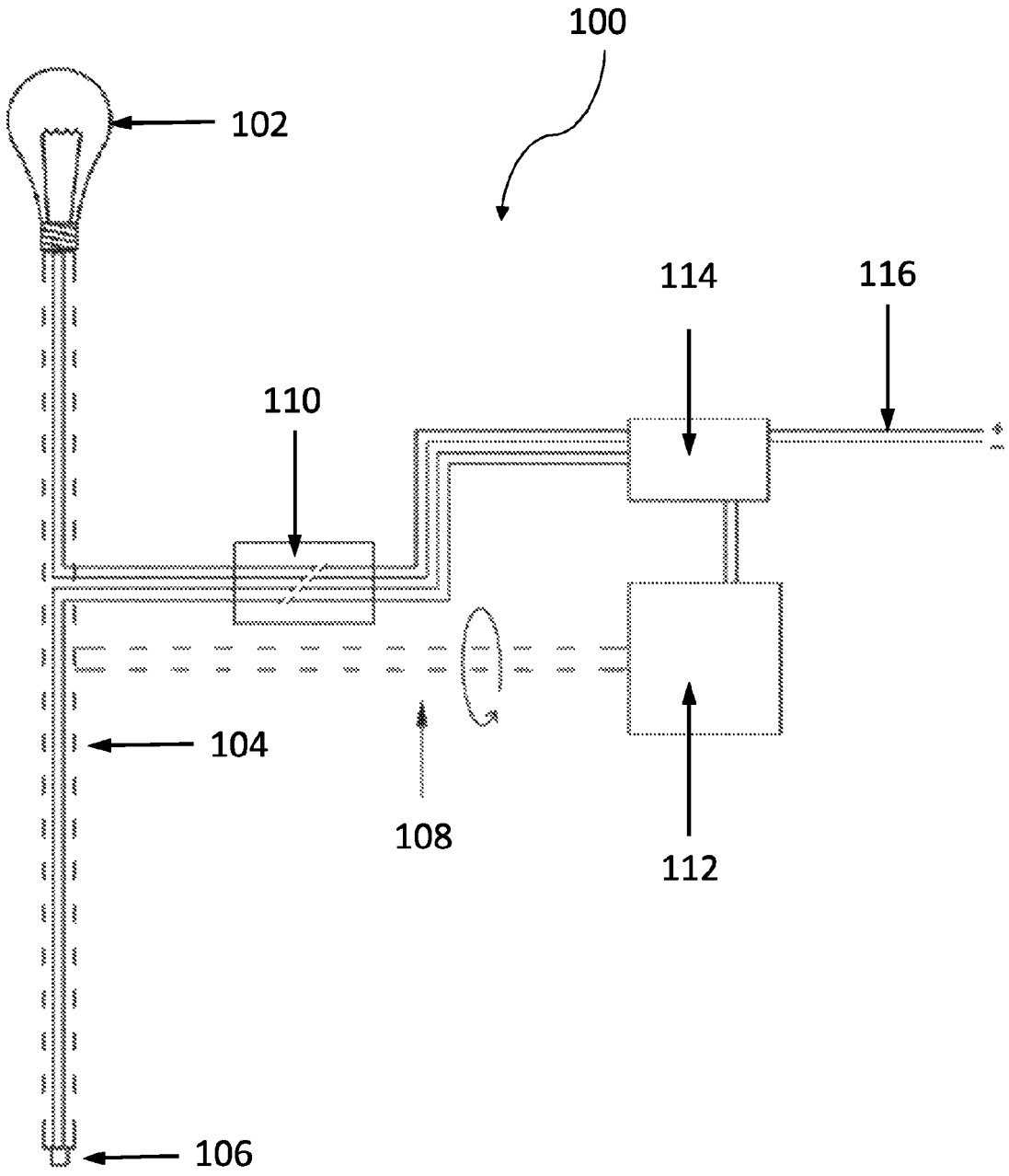
FIG. 2 is a simplified wiring diagram of an exemplary embodiment of a dimmable circuit.

In an exemplary embodiment illustrated in FIGS. 1 and 2, a dimmable circuit 100 for operating a lighting fixture may be provided. The dimmable circuit 100 may allow an operator to control a light characteristic, such as luminosity, color, temperature, and the like, of at least one light source without the use of a conventional power or dimmer switch. For example, an operator may rotate an entire lighting fixture about a stationary housing in order to control the voltage supplied to a light source mounted thereto, thus controlling the luminosity of the light source. This same operation may also be used to control the on/off state of the light source.

In an exemplary embodiment of the invention, the dimmable circuit 100 is operatively connected to an arm fixture 104 having a first end 103 and a second end 105. A light source 102 may be rigidly mounted to the first end 103 of the arm fixture 104 and a push-button switch 106, or the like, may be situated on the opposite, second end 105 of the arm fixture 104. The arm fixture 104 may be formed with an elongated shaft member having a central orifice through which electrical wiring may extend from a power source in a manner well-known in the art. Various lighting settings may be recalled by depression of the push button 106 as will be later described. It may be appreciated that the light source 102 may include an incandescent bulb, LED, laser, halogen, fluorescent, or any desired types of light source, as would be understood by a person having ordinary skill in the art. Further, the light source 102 may be a single source, multiple sources, or any combination of any desired sources, as may be understood by a person having ordinary skill in the art.

The arm fixture 104 may be rotatably coupled to a stationary housing 118 through a shaft 108 rigidly connected to a point along the length of the arm fixture 104. For example, the arm fixture 104 may include indentions for partially surrounding and securing one end of the shaft 108 at a point equidistance between first and second ends 103, 105. The shaft 108 may extend outwardly from the arm fixture 104 at a direction perpendicular to the axis of rotation and continue through an aperture in the stationary housing 118. The shaft 108 may be an elongated shaft body with a central orifice through which electrical wiring passes from the interior of the housing to the arm fixture. A second end of the shaft 108 may be connected to a shaft encoder 112, or other type of encoder as known or desired, located within the stationary housing 118.

The shaft 108 may also carry a slip ring 110 mounted on a portion of the shaft 108 contained within the housing 118. It may be appreciated that the slip ring 110 may provide continuous electrical connection from the electrical control unit 114 located within the housing 118 to the light source 102 mounted on the arm fixture 104 in a known manner. In some exemplary embodiments, for example, the slip ring 110 may include a conductive band mounted on, and insulated from, the shaft 108. As the conductive band rotates in conjunction with the shaft 108, stationary graphite or metal contacts may engage the outside diameter, thereby conducting an electrical current through the stationary contacts to the rotating conductive band. Additional slip ring assemblies may be stacked along the rotating axis if needed. A power cord 116 may be connected to the electrical control unit 114 and may supply power to the dimmable circuit 100. It may further be appreciated that the dimmable circuit 100 may work on any desired voltages, including, but not limited to, voltages under 24V, voltages from approximatively 100V to approximatively 130V, and voltages approximatively from 200V to approximatively 240V, as may be understood by a person of ordinary skill in the art.

Still referring to exemplary FIGS. 1 and 2, the shaft encoder 112 may record the movements of the shaft 108 and provide the electrical control unit 114 with the position of shaft 108. In particular, the shaft encoder 112 may be arranged to rotate in response to rotation of the shaft 108, and may convert the angular position or motion of the shaft 108 into electronic pulses that are transmitted to the electrical control unit 114 via electrical wiring. It may be appreciated that the shaft encoder 112 described herein can be capable of providing a measurement of either the absolute angle of rotation or incremental changes in the angle of rotation of the shaft 108. It may further be appreciated that the shaft encoder 112 may support a broad range of rotation (e.g., multiple complete rotations, as well as rotations below and beyond 360 degrees). In some embodiments, the shaft encoder 112 may also provide an indication of the direction, speed, and/or distance of the rotation.

In turn, the electrical control unit 114 may be equipped with a number of microprocessors, memory storage units, and electrical components that may process data related to the position of shaft 108 to regulate the electrical current fed to the light source 102. Changes in the current may dim, brighten, and turn on or off the light source 102 as may be understood by a person having ordinary skill in the art. The electrical control unit 114 may also regulate various lighting characteristics based on the rotation of the shaft 108, as will be later described.

In another exemplary embodiment, elements of the dimmable circuit, such as, but not limited to, the arm fixture 104 may be rotated so as to control the voltage supplied to the light source 102, thus controlling light characteristics, such as, but not limited to quantity, quality, temperature, and direction of the light source. This same operation of rotation may also be used to turn on or turn off the power supplied to the light source 102. Further, the electrical control unit 114 may be programmed in such a way that the light source may have a varying degree of luminosity (dim to bright, for example) or be turned completely off depending on its position in a 360-degree plane, as registered by the shaft encoder 112. Further, by incorporating the use of slip rings, the arm fixture 104 may be rotated indefinitely while maintaining adequate or desired electrical supply to the light source 102.

Figure 3:
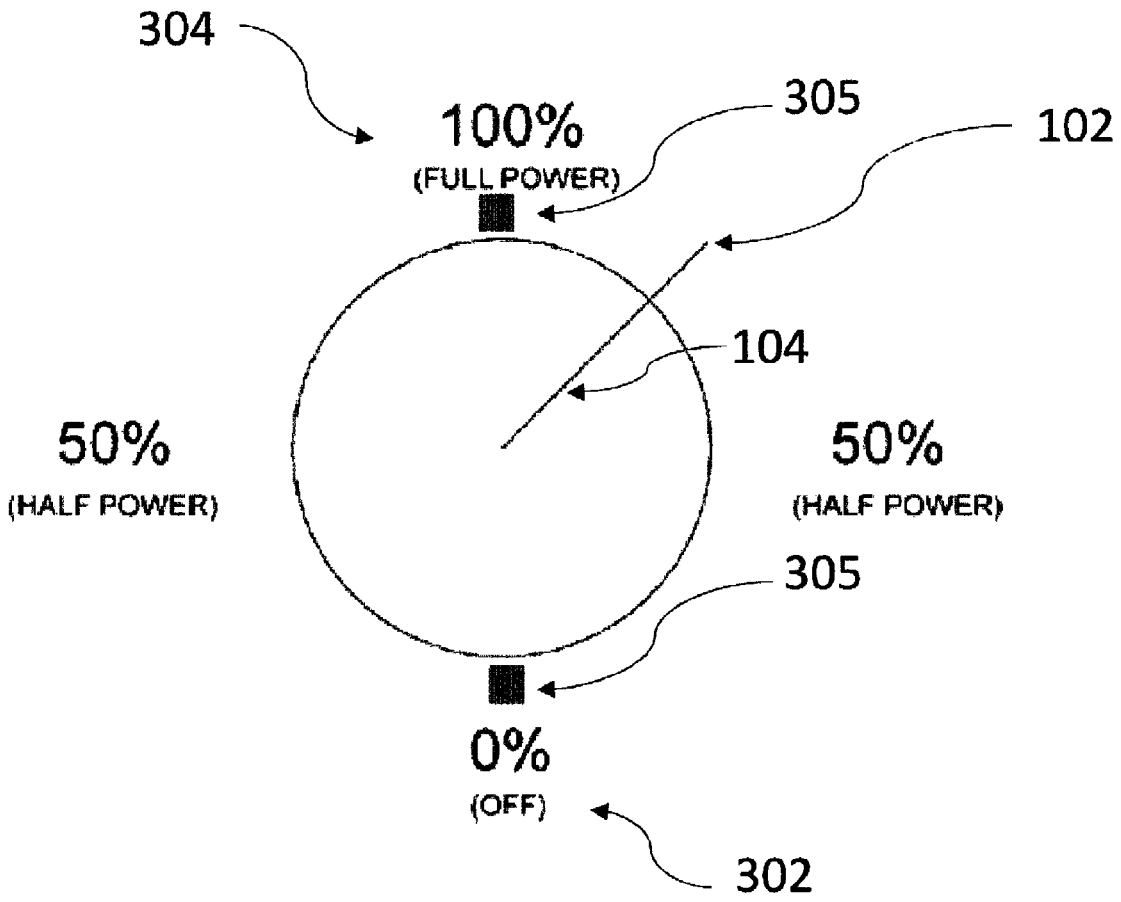
FIG. 3 is a diagram illustrating an exemplary sweep pattern of a dimmable circuit over a 360-degree rotation.

Now referring to exemplary FIG. 3, the rotation of the arm fixture 104 with light source 102 mounted thereto may described by analogy to the rotation of hands around the face of a clock. In viewing FIG. 3, consider the center point of the circle as the center of rotation of the arm fixture. The electrical control unit 114 may be programmed to control the supply of electrical current to the light source 102 based on the angular position of the arm fixture 104 along the axis of rotation. For example, when the light source is positioned at the bottom of the clock face 302 (at the 6 o'clock position), the electrical control unit 114 may break election connection between the power source, thereby turning the light source completely off. When positioned at the top of the clock face 304 (the 12 o'clock position), the light source may illuminate at full brightness. As the light source 102 is rotated from the 6 o'clock position 302 (either clockwise or counter clockwise), the light source 102 may gradually become brighter and may reach full power while at the 12 o'clock position 304. Further, the light source 102 may maintain the light characteristics corresponding to its given position until it is moved to another position, as may be understood by a person having ordinary skill in the art. Further, it may be appreciated that such locations and settings may be adjustable, as desired, in this and other exemplary embodiments.

Figure 4:
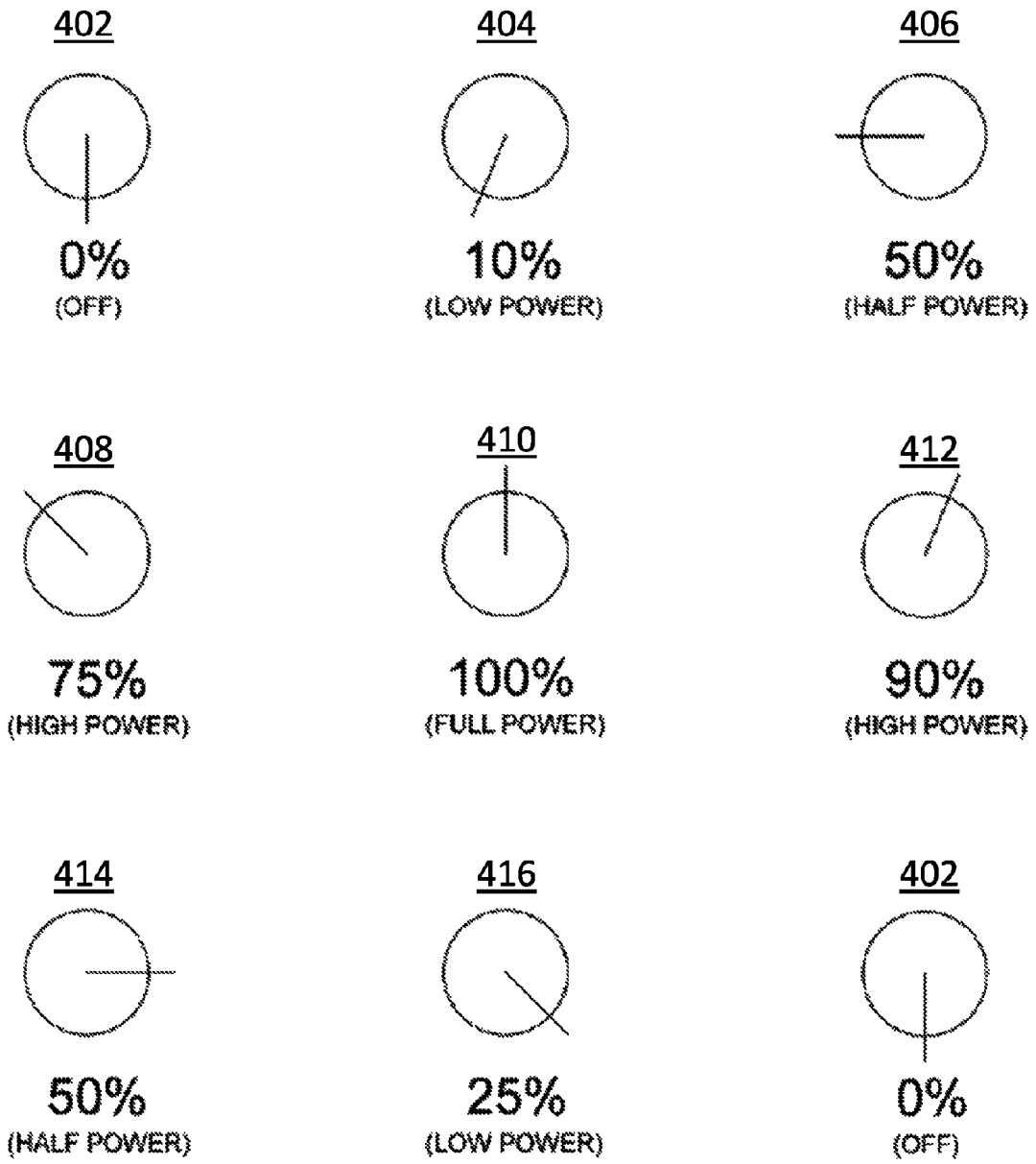
FIG. 4 is a diagram illustrating an exemplary embodiment of a dimmable circuit through a 360-degree rotation of the arm fixture.

Exemplary FIG. 4 may depict a full 360-degree clockwise revolution of the arm fixture along a path of rotation. The arm fixture 104 or any other desired element of the lighting fixture may be rotated from the 6 o'clock position 402 (off) clockwise, to reach the 7 o'clock position 404. Departure from the 6 o'clock position 402 may turn the light source on. As the light source continues to rotate clockwise, beyond the 9 o'clock 406 and 10 o'clock positions 408, light intensity may increase incrementally. Upon reaching the 12 o'clock position 410, the light source 102 may reach full brightness. Continuing clockwise from the 12 o'clock position 410, the light source 102 may gradually start to dim as it reaches the 1 o'clock position 412, 3 o'clock position 414, 4 o'clock position 416, and so forth. Upon completing a full revolution, in which the light source rests at the 6 o'clock position 402, the light source may once again be completely turned off.

In an exemplary embodiment, the dimmable circuit 100 may be able to have a dimming sweep of a full 360 degrees and may incorporate a number of programmable dimming switches that can be controlled by the user. The dimmable circuit 100 may include control devices such as, but not limited to, switches, knobs, or buttons configured to control properties of the light source such as color, temperature or brightness. It may be appreciated that control devices may be connected to any elements of the dimmable circuit 100, as may be understood by a person having ordinary skill in the art.

In another exemplary embodiment, the electrical control unit 114 may be programmed to produce any desired sweep pattern, as defined by light characteristics associated with predetermined positions of any rotatable element of the dimmable circuit 100. The sweep pattern may be changed or altered to allow for different functions of the light source 102. It may further be appreciated that light source characteristics such as, but not limited to, quantity, quality, temperature, and direction of the light may be modified by the electrical control unit 114.

In a further exemplary embodiment, a number of sweep patterns may be pre-programmed into the electrical control unit 114 and may be activated by the push-button switch 106. The electrical control unit 114 may be wirelessly connected to a computing device (for example, by Wi-Fi, BLUETOOTH, or any other known wireless technology as may be understood by a person having ordinary skill in the art) or by a wired connection such as a USB or Ethernet cable. Further, the computing device may include, but is not limited to, a smartphone, a tablet, or a personal computer and may have a software application with an interface that may allow a user to update, create, edit, and save sweep patterns, as may be understood by a person of ordinary skill in the art. It may be appreciated that sweep patterns may be modified according to the time of the day, measured angular speed of the shaft, or input from external sensors such as, but not limited to, light sensors, noise level sensors, or motion sensors. Sweep patterns may further be randomized or automatically generated according to preset logics.

Figure 5A:
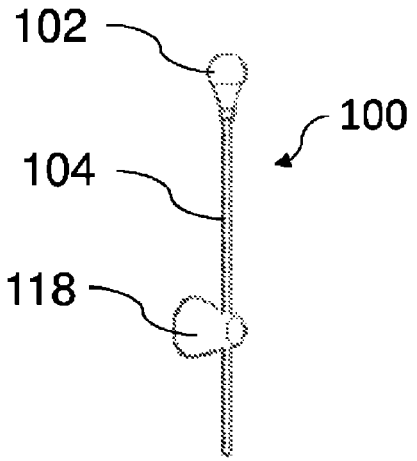
FIG. 5A is a perspective view of an exemplary embodiment of a dimmable circuit with a light source mounted to an end of a vertical support structure.
Figure 5B:
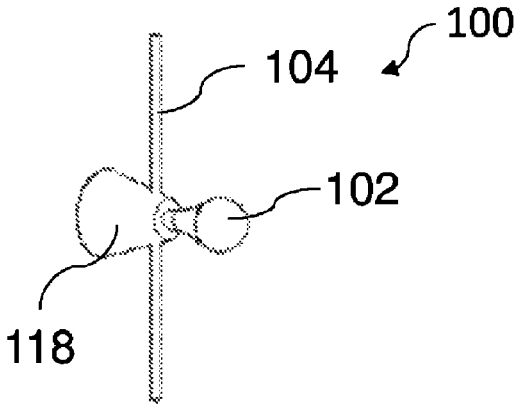
FIG. 5B is a perspective view of an exemplary embodiment of a dimmable circuit with a light source mounted in the center of a vertical support structure.
Figure 5C:
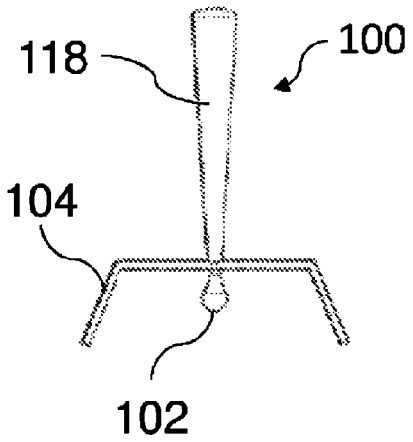
FIG. 5C is a perspective view of an exemplary embodiment of a dimmable circuit with a light source mounted in the center of a horizontal support structure.
Figure 5D:
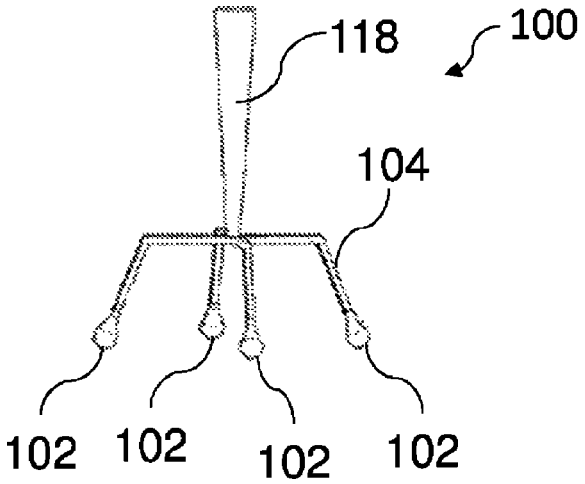
FIG. 5D is a perspective view of an exemplary embodiment of a dimmable circuit with four peripheral light sources mounted to a horizontal support structure.

In an exemplary embodiment illustrated in FIGS. 5A-5D, the design and construction of the lamp may be modified to produce a number of variations of the same dimmable circuit. As illustrated in FIGS. 5A-5B, the dimmable circuit 100 may be mounted on vertical walls, with the light source 102 proximate one end of the arm fixture 104 as shown in FIG. 5A or the light source 102 may be connected to the housing 118, at the center of the lamp as depicted in FIG. 5B. The dimmable circuit 100 may also be fixed to ceilings with a light source connected to the housing 188 and an angled arm fixture 104 as shown in FIG. 5C. FIG. 5D illustrates an example of a dimmable circuit 100 configured with a 4-pronged arm fixture 104 and light sources proximate each prong. Other exemplary embodiments may be configured to be placed on the floor, or on a table. In a further exemplary embodiment, audio speakers may be incorporated in the dimmable circuit 100 and control for raising and lowering of volume may be provided, as may be understood by a person of ordinary skill in the art.

In another exemplary embodiment, the dimmable circuit 100 may include a mechanism that may give a tactile notice when the arm fixture 104 has reached a predetermined position. For example, a raised bump 305 at the 12 o'clock or 6 o'clock position may give perceptible tactile notice that the arm fixture is at full brightness, or in the off position, as may be understood by a person of ordinary skill in the art.

Figure 6:
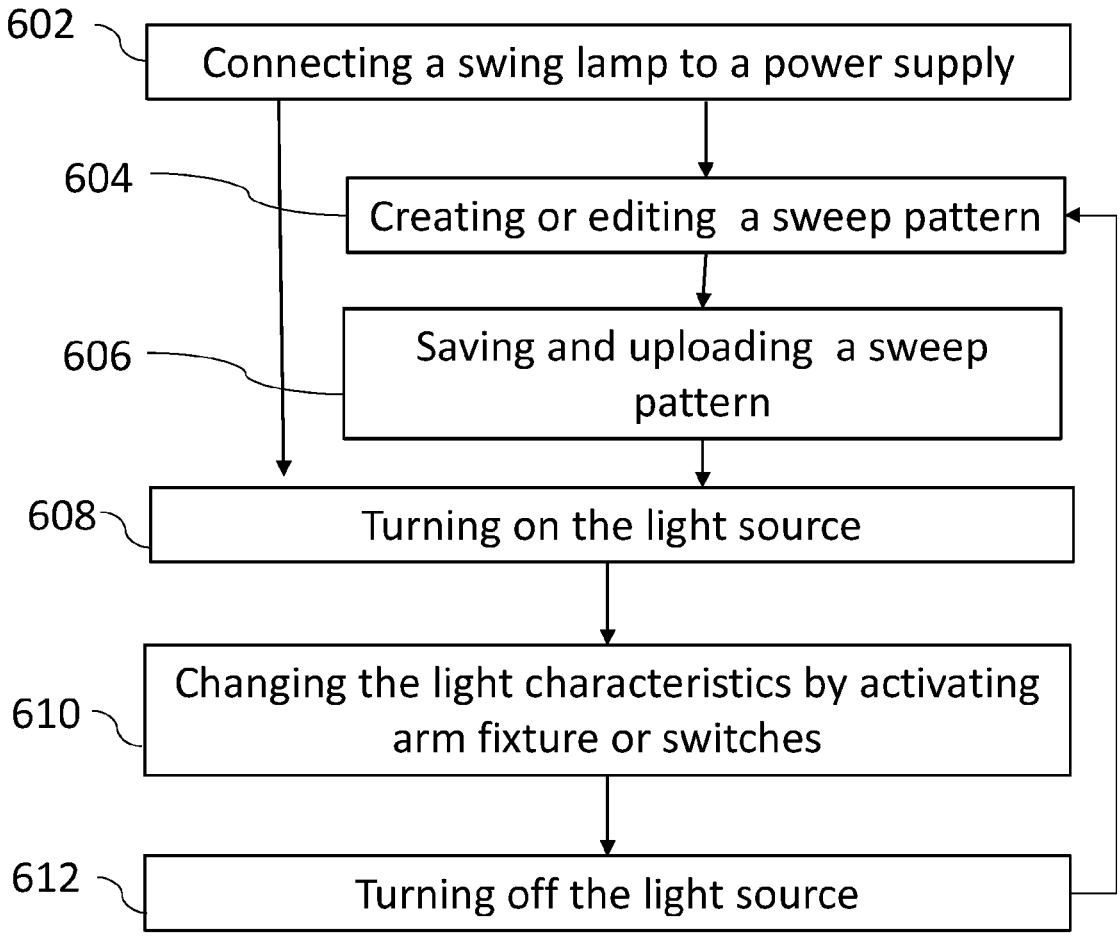
FIG. 6 is a block diagram depicting the method steps of an exemplary embodiment of the present invention.

According to an exemplary embodiment, a method of dimming light may be illustrated in exemplary FIG. 6. The method may include connecting the dimmable circuit 100 to a power supply 602 before turning on the light source 608 and changing the light characteristics 610. The method of dimming light may further include the steps of creating and editing a sweep pattern 604 and saving and uploading a sweep pattern 606 to a computing device before turning on the light source 608. In some exemplary embodiments, an operator may download and utilize a software application on a computing device to create and store a desired sweep pattern for the lighting fixture. The desired sweep pattern, for example, may change the light source luminosity with every 5-degree rotation of the arm fixture. The computing device may wirelessly transmit the desired sweep pattern to the electrical control unit 114 for execution by a microprocessor in the electrical control unit. It may further be appreciated that the sweep patterns may be modified at any desired step of the method, as may be understood by a person having ordinary skill in the art. The light source 102 may be turned on 608 by rotating the arm fixture 104 from a 6 o'clock position. Alternatively, the light source 102 may be activated by depressing the push-button switch 106 at one end of the arm fixture 104. Light source characteristics (e.g., color, temperature, brightness) may be altered 610 by rotation of the arm fixture, activation of a programmable dimming switch, modification of the software application, or any other method as may be understood by a person having ordinary skill in the art. Each functionality may be pre-programmed into the electrical control unit or adjusted according to user preference.

Figure 7:
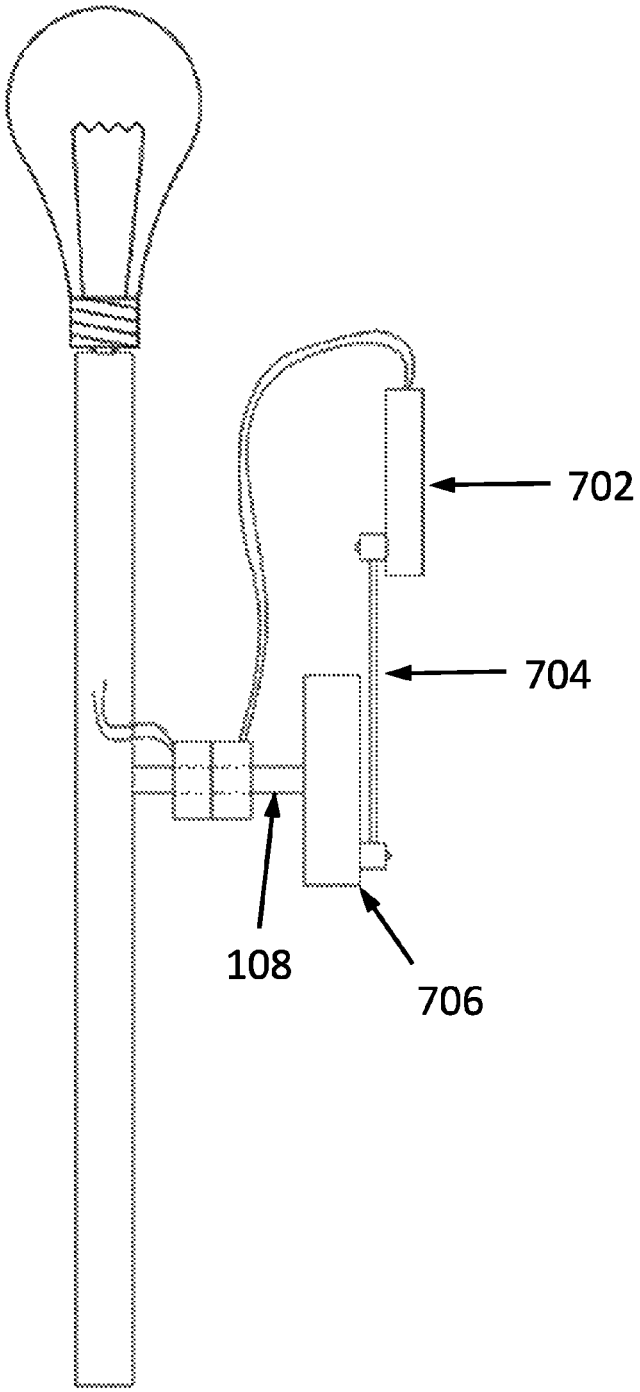
FIG. 7 is a perspective view of an exemplary embodiment of a dimmable circuit with a linear potentiometer.
Figure 8:
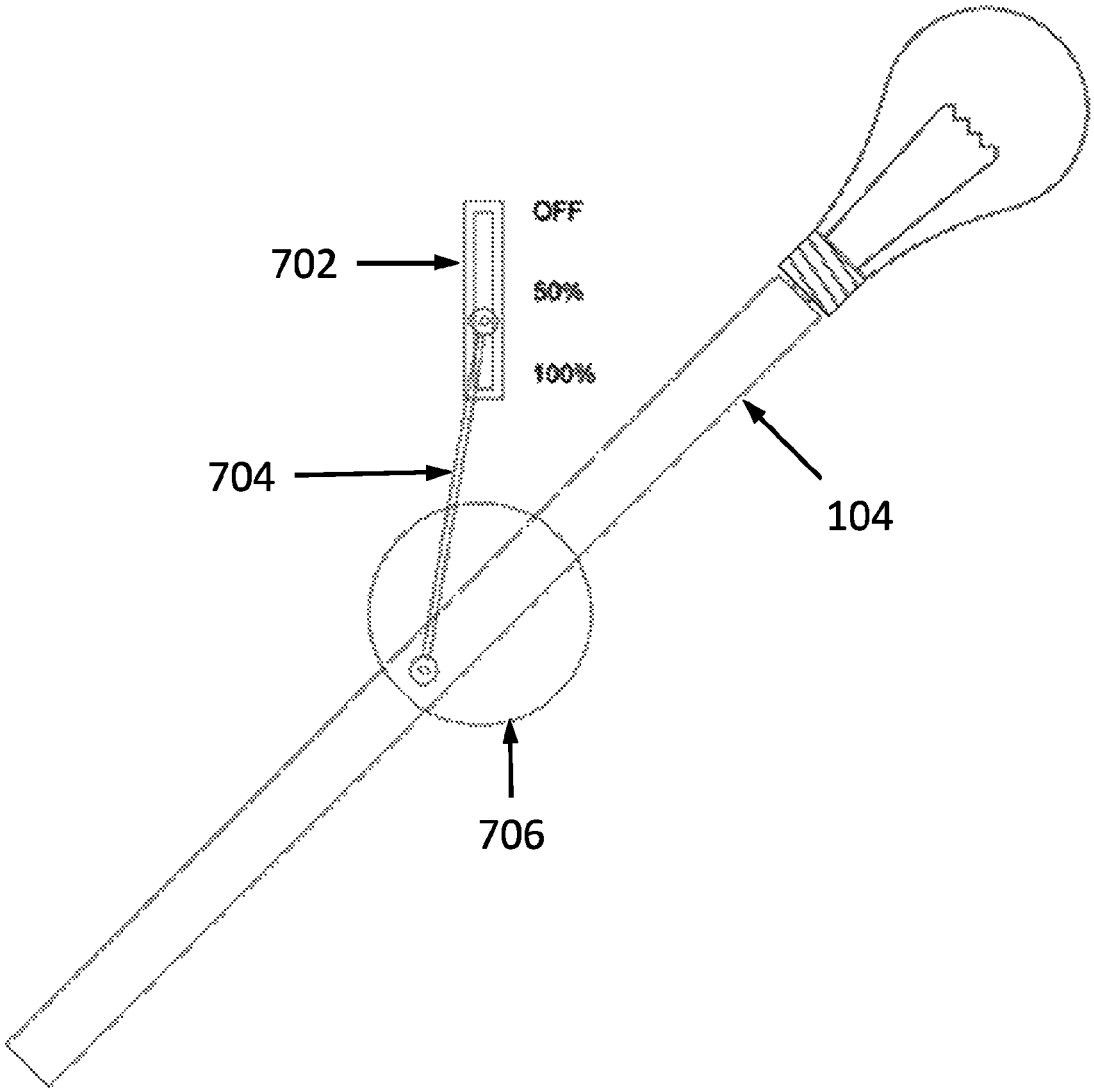
FIG. 8 is a perspective view of another exemplary embodiment of a dimmable circuit with a linear potentiometer.

According to another exemplary embodiment illustrated in FIGS. 7 and 8, a dimmable circuit 100 including a linear potentiometer 702 may be provided. The shaft 108 may be driven rotationally, for example, by movement of the arm fixture 104 or the like, that may be activated by a user. The shaft 108 may be rigidly connected to a wheel 706, which may cause rotational movement of the wheel 706 when the shaft is driven rotationally. Further, a connecting rod 704 may have a first end connected to the outer part of the wheel 706 and a second end connected to a linear potentiometer 702. When actuated, the wheel 706 may engage the connecting rod 704 that may convert the rotational movement of the wheel into a longitudinal movement applied to the linear potentiometer 702. This conversion from rotational movement to longitudinal movement may be achieved as with a slider crank, or with any techniques utilized for conversion between linear and rotary motions, as may be understood by a person of ordinary skill in the art. Thus, the shaft 108 and the wheel 706 may be rotated as desired and impart the corresponding longitudinal motion to the linear potentiometer 702. In some exemplary embodiments, the connecting rod 704 may be configured to transfer longitudinal movement to one or more linear potentiometers 702.

Figure 9:
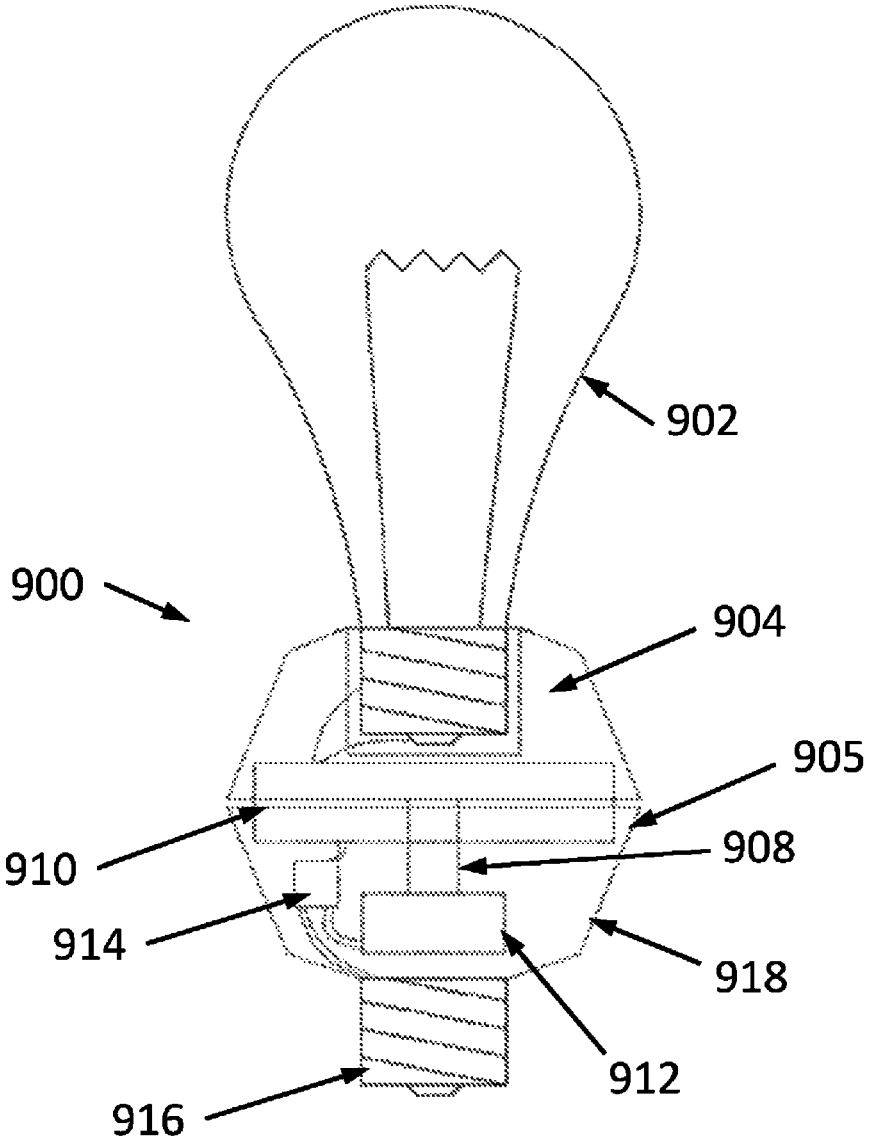
FIG. 9 is a perspective view of an exemplary embodiment of a dimmable circuit.

In another exemplary embodiment illustrated in FIG. 9, dimmable circuit 900 may be provided. The dimmable circuit 900 may be produced as a standalone accessory and may be added to any light fixture so that it can be modified to become a dimmable circuit. The dimmable circuit 900 may be designed as an adapter and may include a light source 902 such as, but not limited to, a bulb connected to a housing 918. It may be appreciated that the light source 902 may include incandescent bulb, LED, laser, halogen, fluorescent, or any desired types of light source, as would be understood by a person having ordinary skill in the art. Further, the light source 902 may include a single source, multiple sources, or any combination of desired sources, as may be understood by a person having ordinary skill in the art. A first part 904 of the housing 918 may be rotatably connected to a second part 905 of the housing 918 through a shaft 908 rigidly connected to the first part 904. The shaft 108 may be connected to a shaft encoder 912 or other types of encoders as known or desired, and may carry a slip ring 910. It may be appreciated that the slip ring 910 may provide continuous electrical connection from an electrical control unit 914 to the light source 902. An electrical socket 916 may be connected to the electrical control unit 914 and may supply power to the dimmable circuit 900. It may be appreciated that any desired type of socket or connector may be connected to the electrical control unit 914, as may be understood by a person having ordinary skill in the art.

The foregoing description and accompanying figures illustrate the principles, preferred embodiments and modes of operation of the invention. However, the invention should not be construed as being limited to the particular embodiments discussed above. Additional variations of the embodiments discussed above will be appreciated by those skilled in the art.

Therefore, the above-described embodiments should be regarded as illustrative rather than restrictive. Accordingly, it should be appreciated that variations to those embodiments can be made by those skilled in the art without departing from the scope of the invention as defined by the following claims.

What is claimed is:

1. A dimmable light circuit, comprising:

a housing;

an arm fixture with at least one light source mounted thereto;

a rotatable shaft coupled to the arm fixture that provides angular rotational movement of the arm fixture about the housing, the angular rotational movement being 360-degrees in either direction from any point along a path of rotation;

an encoder connected to the rotatable shaft to generate and transmit data on the angular rotational movement of the rotatable shaft;

an electrical control unit that receives and processes data from the encoder, and further regulates an electrical current flowing to the at least one light source based on an angular position of the rotatable shaft, thereby controlling an intensity of the at least one light source; and a slip ring attached to the rotatable shaft that transmits electric power from the electrical control unit to the at least one light source.

2. The dimmable light circuit of claim 1, wherein the electrical control unit comprises at least one non-transitory computer-readable medium storing executable instructions and a microprocessor adapted to execute the instructions.

3. The dimmable light circuit of claim 1, further comprising a control device communicatively coupled to the electrical control unit to control properties of the at least one light source, including at least one of color, temperature, and brightness.

4. The dimmable light circuit of claim 1, wherein the electrical control unit is programmed to produce a desired sweep pattern as the rotatable shaft moves the arm fixture along the path of rotation, the sweep pattern defined by activation of predefined light characteristics of the at least one light source at predetermined positions of the rotatable shaft.

5. The dimmable light circuit of claim 1, wherein the electrical control unit stores a plurality of different sweep patterns.

6. The dimmable light circuit of claim 1, further comprising a push-button disposed on the arm fixture, the push-button configured to control an on/off state of the at least one light source.

7. The dimmable light circuit of claim 5, wherein a push-button is configured to enable a user to select a desired sweep pattern from the plurality of sweep patterns.

8. The dimmable light circuit of claim 7, wherein the selected sweep pattern can be modified according to at least one of: a time of day, a measured angular speed of the shaft, and an input from an external sensor.

9. The dimmable light circuit of claim 8, wherein the external sensor is one of: a light sensor, a noise level sensor, and a motion sensor.

10. The dimmable light circuit of claim 1, further comprising audio speakers communicatively coupled to the electrical control unit, wherein the electrical control unit adjusts a volume of the audio speakers based on data related to the angular rotational movement of the rotatable shaft.

11. The dimmable light circuit of claim 1, further comprising at least one raised bump that provides perceptible tactile notice when the rotatable shaft reaches a predetermined position along the path of rotation.

12. The dimmable light circuit of claim 1, further comprising a wireless transmitter communicatively coupled to the electrical control unit and configured to transmit data received from a user-operated computing device.

13. The dimmable light circuit of claim 12, wherein the computing device is one of: a smartphone, a tablet, and a personal computer.

14. The dimmable light circuit of claim 12, wherein the computing device further comprises a software module for entering commands for selectively controlling the at least one light source.

15. The dimmable light circuit of claim 14, wherein the software module provides functionality to create, edit and save sweep patterns to the electrical control unit.

16. The dimmable light circuit of claim 1, further comprising:

at least one linear potentiometer;

a wheel rotationally driven by the rotatable shaft; and a connecting rod having a first end connected to an outer part of the wheel and a second end connected to the at least one linear potentiometer;

wherein the connecting rod converts the rotational movement of the wheel into a longitudinal movement applied to the at least one linear potentiometer.

17. The dimmable light circuit of claim 16, wherein the at least one linear potentiometer is a plurality of linear potentiometers and the connecting rod is configured to transfer longitudinal movement to the plurality of linear potentiometers.

18. The dimmable light circuit of claim 1, wherein the at least one light source is one of: an LED, a laser, an incandescent bulb, a halogen bulb, and a fluorescent bulb.

* * * * *